United States Patent [19]

Aronson

[11] Patent Number: 4,544,002

[45] Date of Patent: Oct. 1, 1985

[54] AUTOMATIC SPRING COMPRESSING MACHINE

[76] Inventor: David V. Aronson, 5955 Sibley Rd., Chelsea, Mich. 48118

[21] Appl. No.: 600,550

[22] Filed: Apr. 16, 1984

[51] Int. Cl.[4] ..... B21F 35/00

[52] U.S. Cl. ..... 140/89; 72/424

[58] Field of Search ..... 140/89; 72/424; 221/200, 202

[56] References Cited

U.S. PATENT DOCUMENTS

| | | | |
|---|---|---|---|
| 377,803 | 2/1888 | Goddard | 140/89 |
| 496,722 | 5/1893 | Cliff | 140/89 |
| 1,633,010 | 6/1927 | Findora | 140/89 |
| 1,981,135 | 11/1934 | Block | 221/200 |
| 4,101,284 | 7/1978 | Difiglio et al. | 221/264 |

*Primary Examiner*—Francis S. Husar
*Assistant Examiner*—Robert Showalter
*Attorney, Agent, or Firm*—Beaman & Beaman

[57] ABSTRACT

A machine for compressing compression coil springs to length. A crank-operated plunger reciprocates within a chamber receiving springs to be compressed, and from a magazine springs are automatically fed into the compression chamber and released therefrom. Transfer of the springs from the magazine to the chamber and retaining and release of the springs relative to the chamber is controlled by cam operated plates.

5 Claims, 9 Drawing Figures

IV
IV

AUTOMATIC SPRING COMPRESSING MACHINE

BACKGROUND OF THE INVENTION

Compression springs often require longitudinal sizing, and while such sizing may be accomplished by severing the springs to the desired length, some spring applications require sizing and conditioning by longitudinal compression. By compressing the springs a predetermined extent, usually until adjacent coils contact, spring characteristics can be standardized and longitudinal, dimensional variations reduced.

Spring compression machines are known wherein plungers compress compression springs while retained on a mandrel, or otherwise positioned. While previously patented spring compression machines do show means for handling a plurality of springs and position the springs at a compression station, prior apparatus, to the inventor's knowledge, has not been available to provide economical high production spring compression with relatively inexpensive equipment.

It is an object of the invention to provide a spring compression machine which may be economically manufactured and operated, and which automatically compresses springs to a predetermined extent.

Another object of the invention is to provide a spring compression machine having a compression chamber wherein springs are fed from a magazine into the chamber.

Yet an additional object of the invention is to provide a spring compression machine having a compression chamber wherein elongated springs are automatically fed from the magazine to the compression chamber, and automatically released from the chamber after compression.

In the practice of the invention the apparatus is mounted upon a frame and includes an electrically driven driveshaft disposed at right angles to the frame length. A crank is mounted upon the driveshaft for reciprocating a plunger during each driveshaft rotation, and the plunger extends into a spring compression chamber wherein the springs are compressed. An anvil block at the end of the chamber opposite to the plunger engages the spring end and positions the spring during compression.

Sliding plates are disposed above and below the compression chamber, and these plates are successively translated relative to the compression chamber for retaining the spring therein during compression, and feeding and releasing springs into and from the chamber. The plates are operated by cams driven from the driveshaft wherein synchronization between spring compression and plate operation is achieved.

A magazine located above the compression chamber drops springs into the loading plate, and an agitator within the magazine minimizes the likelihood of clogging within the magazine.

The spring compression operation in accord with the invention is entirely automatic and the apparatus operates at a high production capacity requiring only that the magazine be periodically replenished with springs to be processed.

BRIEF DESCRIPTION OF THE DRAWINGS

The aforementioed objects and advantages of the invention will be appreciated from the following description and accompanying drawings wherein:

FIG. 8 is an elevational, detail, sectioal view of the magazine, and FIG. 9 is an elevational, detail, partially sectioned view of the magazine apparatus and operating cam.

DECRIPTION OF THE PREFERRED EMBODIMENT

Figure 1:
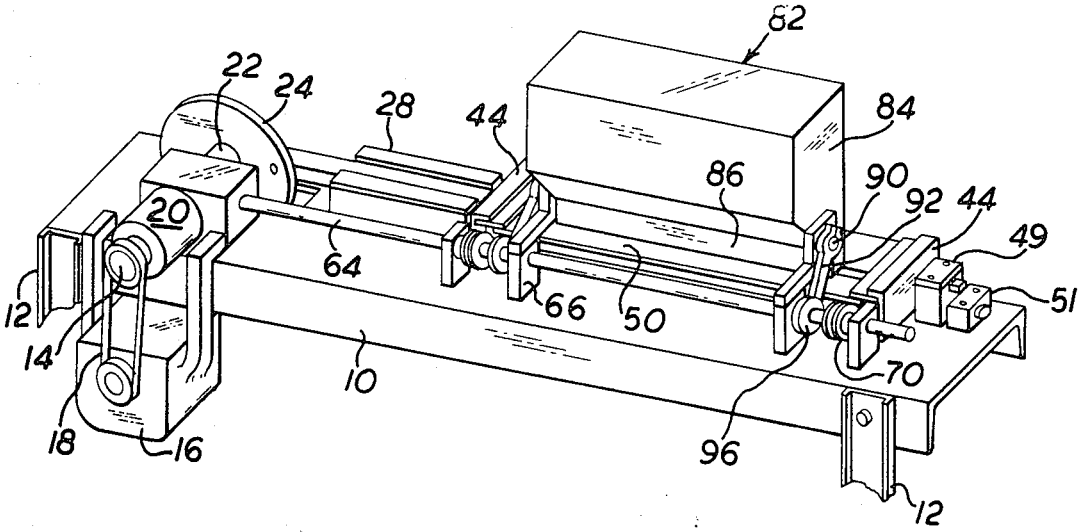
FIG. 1 is a perspective view of a spring compressing machine in accord with the invention.

The apparatus of the invention includes an elongated frame 10 supported upon legs 12. A driveshaft 14 is rotatably mounted upon the frame on conventional bearings and is driven by an electric motor 16 through belt 18. The driveshaft 14 drives a speed reducing transmission 20 which rotates the output shaft 22 at a slower rate, and the shaft terminates in a flywheel crank 24 having eccentric pin 26 mounted thereon.

A guide block 28 is mounted upon the frame adjacent the flywheel crank 24 and includes an elongated bore 30 for receiving the plunger block 32 reciprocating therein which is pivotally attached to the eccentric pin 26 by the pin 34 and connecting rod 36. The elongated plunger 38 is attached to the plunger block 32 and extends into the spring compression chamber 40.

The spring compression chamber 40 is defined by a plate 42 fixed to the frame 10 upon brackets 44. The plate 42 is of a planar configuration and includes the longitudinally extending chamber 40 centrally defined therein which is in alignment with the plunger 38. The plate 42 also includes an upper surface 46, and a lower surface 48.

Figures 2, 3, 4, 5, 6:
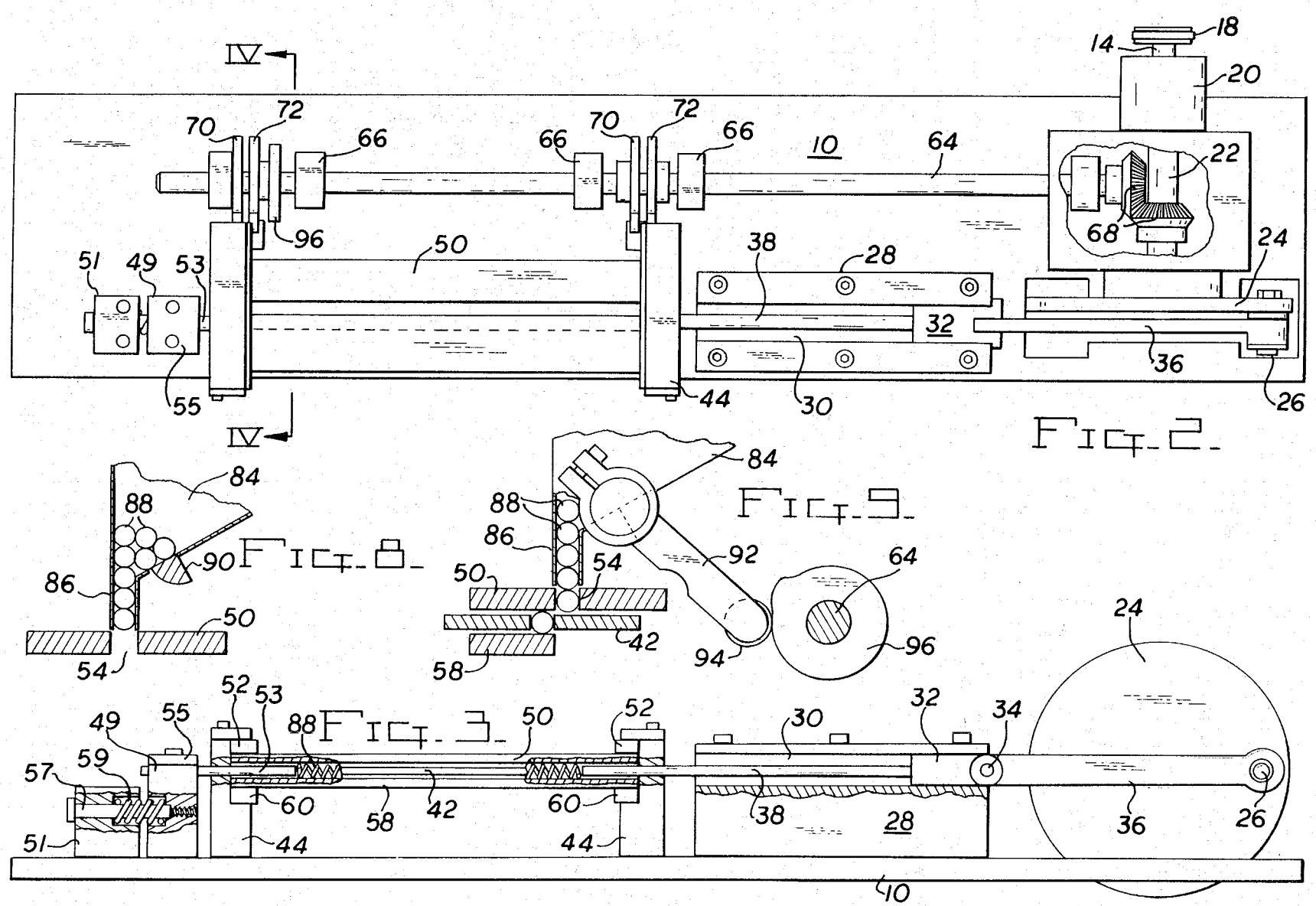
FIG. 2 is a top plan view of the spring compression apparatus, the magazine being omitted for clarity of illustration.
FIG. 3 is an elevational view, partially sectioned, and with the magazine omitted, illustrating the crank and plunger, and the anvil block.

The anvil block 49 is movably mounted upon the frame 10 by an anchor block 51 fixed to the frame. The block 49 adjustably supports an anvil rod 53 by screw clamp 55 and the rod 53 extends into compression chamber 40 to engage the left end of a spring being compressed, FIG. 3. The anvil block 49 is supported by the anchor block 51 by pin 57 surrounded by spring 59 whereby spring 59 absorbs the shock imposed upon the anvil rod and block during spring compression.

The spring loading plate 50 is mounted upon the brackets 44 for slidable movement transverse to the length of the compression chamber upon slide blocks 52. The loading plate 50 is of a planar configuration and includes a slot 54 and a lower surface 56 in spaced parallel relationship to the plate 42 upper surface 46.

The release plate 58 is mounted below the compression chamber defining plate 42 and is mounted upon slide blocks 60 supported upon brackets 44 for transverse movement to the length of the spring compression chamber 40, and includes an upper surface 62 in spaced parallel relationship to the plate lower surface 48.

Operation of the loading and release plates is through a camshaft 64 rotatably mounted upon the frame 10 by bearings 66 drivenly connected to the output shaft 22 through beveled gearing 68. A pair of spaced load plate cams 70 are mounted upon the cam shaft 64, and a pair of release plate cams 72 are also mounted thereon. The slide 52 includes a follower roller 74 at each bracket 44 engaging a cam 70, while the slide 60 also includes a cam follower roller 76 at each bracket in engagement with a cam 72. Each of the slides 52 and 60 are biased toward its associated cams by compression springs 78 and 80, respectively, FIG. 4, and by means of the cams and associated rollers the plates 50 and 58 will be translated transversely with respect to the spring compression chamber 40 in synchronization with the movement of the spring compression plunger 38.

The springs are automatically fed to the loading plate 50 by means of a magazine 82 mounted upon the frame. The magazine includes a hopper portion 84 having an outlet portion 86, FIGS. 8 and 9, adapated to stack the springs 88 one above the other and align with the slot 54 of the plate 50. To prevent clogging and binding of the springs within the hopper, an agitator 90 is pivotally mounted at the ends of the magazine for engaging and agitating springs adjacent the outlet portion 86, and the agitator is oscillated by means of a lever 92 and cam follower 94 engaging cam 96 mounted upon the cam shaft 64. Thus, as the shaft 22 and camshaft 64 rotate, the agitator 90 will maintain movement of the springs 88 in the hopper 84 to minimize binding and clogging.

Figure 4:
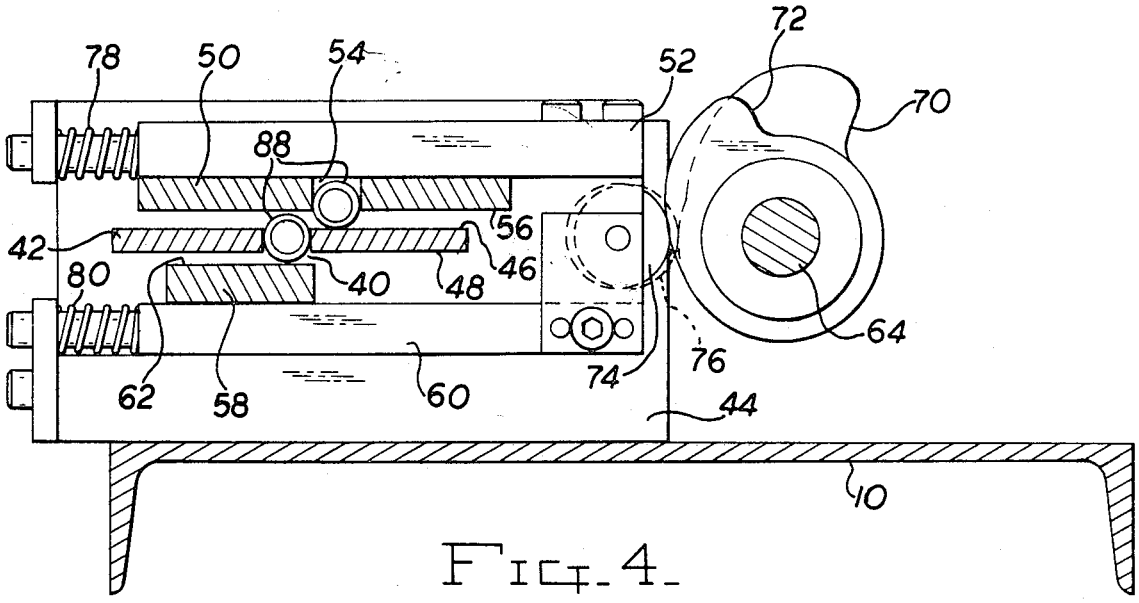
FIG. 4 is a transverse, sectional view taken through the spring compression chamber along Section IV—IV of FIG. 2, the magazine not being illustrated.
Figure 5:
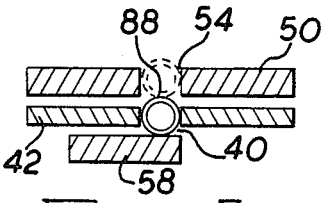
FIG. 5 is an elevational,sectional view of the compression chamber and load and release plates illustrating the chamber loading position.

In operation, the plates 42, 50 and 58 will be oriented as shown in FIGS. 4 and 9, which is the loading position for the plate 50. In this portion the slot 54 of the loading plate will be in alignment with the magazine outlet 86, FIG. 9, and a spring 88 will drop from the magazine outlet into the slot 54. The rotation of the camshaft 64 translates the plate 50 to the left to the position of FIG. 5 aligning the slot 54 with the compression chamber 40 permitting the spring 88 to drop into the compression chamber. As the plate 58 will be positioned directly below the chamber 40, the spring engages the surface 62 and is properly oriented within the spring compression chamber.

Figure 6:
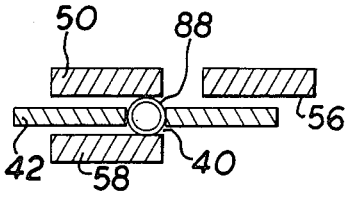
FIG. 6 is a view similar to FIG. 5, illustrating the plates' positions during spring compression.

Thereupon, the plate 50 returns to the "loading" position of FIG. 6 to pick up another spring in slot 54 and as the lower surface 56 is now disposed above the spring compression chamber and the spring 88 is securely retained within the compression chamber. At this time the plunger 38 enters the compression chamber 40 compressing the spring 88 therein and forcing the spring against the compression axial rod 53 producing the desired degree of spring compression for sizing and stressing.

Figure 7:
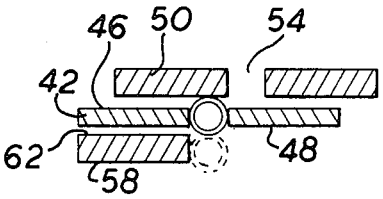
FIG. 7 is a view similar to FIG. 5 illustrating the plates during spring release from the compression chamber and reloading of a spring into the loading plate.

The next movement is that of the release plate 58 which shifts to the left, FIG. 7, clearing the release plate surface 62 from alignment with the chamber 40 permitting the spring to fall through an opening in the frame to a container positioned therebelow. The plate 58 then returns to the position of FIG. 4.

Thereupon, the cycle is repeated, and it will be noted that even prior to release of a spring 88 from the compression chamber 40, the slot 54 will be in alignment with the magazine outlet 86 to be receiving a new spring, and the cycle of operation can be very quickly repeated. As the spacing between plate surfaces 46 and 56, and 48 and 62 is such as to closely confine the spring within compression chamber 40, the spring will not laterally displace during compression.

The anvil rod 53 may be easily adjusted to permit accommodation of various sizes of springs by adjusting clamp 55, and the shock absorbing cushioning provided by spring 59 reduces noise, stress and metal fatigue. Further, the adjustment of the anvil rod 53 gives a uniform and adjustable bottoming pressure. By closely controlling the pressure imposed upon the spring being compressed, the spring load factor may be regulated wherein the load factor is increased without requiring additioal spring weight or material. The compression characteristics can also be controlled by closely regulating the characteristics of spring 59, and spring 59 may be prestressed by adjustment of shaft 57 to vary the cushioning specifications.

It will be appreciated from the above description that a spring compression apparatus of the invention is economical to manufacture, adequately supports the spring during compression for accurate sizing, and is capable of high production operation. It is understood that various modifications to the inventive concepts may be apparent to those skilled in the art without departing from the spirit and scope of the invention.

I claim:

1. An automatic spring compressing machine comprising, in combination, a frame, an elongated spring compression chamber defined upon said frame having an upper entrance opening and a lower egress opening, an elongated axially movable plunger mounted on said frame within said chamber adapted to compress a spring therein, plunger operating means mounted upon said frame, a spring load plate mounted on said frame above said compression chamber movable between spring load and transfer positions, spring load plate operating means mounted upon said frame, said spring load plate having an elongated spring receiving slot defined therein aligning with said chamber upper entrance opening at said spring load position to permit a spring to drop from said slot into said chamber and a lower side extending over said chamber at said transfer position to confine a spring within said chamber during compression, a release plate mounted upon said frame below said compression chamber movable between spring retaining and spring release positions, release plate operating means mounted upon said frame, said release plate having an upper side aligning with said chamber egress opening at said spring retaining position to confine a spring in said chamber during compression and said release plate misaligning with said egress opening at said spring release position permitting a spring to drop from said chamber.

2.In an automatic spring compression machine as in claim 1, said spring load plate and said release plate comprising flat plates.

3. In an automatic spring compression machine as in claim 2, a shaft rotatably mounted upon said frame, an electric motor drivingly connected to said shaft, a crank mounted upon said shaft, said plunger being drivingly connected to said crank, said spring load and release plate's operating means comprising a camshaft rotatably mounted on said frame and drivingly connected to said shaft, cam means defined on said camshaft, and cam follower means defined upon said plates whereby rotation of said camshaft positions said plates between their respective positions in synchronization with operation of said plunger.

4. In an automatic spring compression machine as in claim 1, a spring magazine mounted upon said frame receiving a plurality of springs, an outlet defined within said magazine in alignment with said spring load plate spring receiving slot when said spring load plate is in said spring load position.

5. In an automatic spring compression machine as in claim 4, spring agitator means defined in said magazine adjacent said magazine outlet.

* * * * *